US006935886B2

(12) United States Patent
Hoch et al.

(10) Patent No.: US 6,935,886 B2
(45) Date of Patent: Aug. 30, 2005

(54) PLUG CONNECTOR HAVING A HOUSING AND A CLAMPING INSERT

(75) Inventors: Achim Hoch, Waldkirch (DE); Frank Köhler, Buchholz-Batzenhäusle (DE); Günter Reich, Elzach (DE); Manfred Stratz, Simonswald (DE); Mario Bartholomä, Winden (DE)

(73) Assignee: Anton Hummel Verwaltungs GmbH, Waldkirch (DE)

( * ) Notice: Subject to any disclaimer, the term of this patent is extended or adjusted under 35 U.S.C. 154(b) by 0 days.

(21) Appl. No.: 10/496,532

(22) PCT Filed: Feb. 7, 2003

(86) PCT No.: PCT/EP03/01202

§ 371 (c)(1),
(2), (4) Date: May 24, 2004

(87) PCT Pub. No.: WO03/077373

PCT Pub. Date: Sep. 18, 2003

(65) Prior Publication Data

US 2005/0032414 A1 Feb. 10, 2005

(30) Foreign Application Priority Data

Mar. 9, 2002 (DE) ..... 202 03 788

(51) Int. Cl.[7] ..... H01R 13/58
(52) U.S. Cl. ..... 439/462
(58) Field of Search ..... 439/462, 461, 439/460

(56) References Cited

U.S. PATENT DOCUMENTS

| | | | | | |
|---|---|---|---|---|---|
| 3,858,960 | A | | 1/1975 | Kunkle et al. | |
| 4,191,443 | A | * | 3/1980 | Doyle | 439/462 |
| 4,199,207 | A | * | 4/1980 | Lee | 439/102 |
| 4,389,082 | A | | 6/1983 | Lingaraju | |
| 4,593,962 | A | * | 6/1986 | Knorreck et al. | 439/277 |
| 4,647,127 | A | * | 3/1987 | Weingartner | 439/289 |
| 4,673,231 | A | * | 6/1987 | McAnulty, Sr. | 439/587 |
| 5,080,614 | A | * | 1/1992 | Utgaren | 439/695 |
| 5,178,559 | A | | 1/1993 | Mello | |
| 5,368,505 | A | | 11/1994 | Hoolhorst | |
| 5,564,942 | A | * | 10/1996 | Lee | 439/462 |
| 5,755,589 | A | * | 5/1998 | Koch | 439/427 |
| 6,116,945 | A | * | 9/2000 | Davis et al. | 439/462 |
| 6,582,248 | B2 | * | 6/2003 | Bachman | 439/462 |
| 6,648,674 | B1 | * | 11/2003 | Dobler | 439/460 |
| 6,752,650 | B1 | * | 6/2004 | Lin | 439/491 |
| 6,817,902 | B2 | * | 11/2004 | Bernardi et al. | 439/676 |

FOREIGN PATENT DOCUMENTS

| | | |
|---|---|---|
| DE | 4234451 | 4/1994 |
| EP | 0772259 | 5/1997 |

* cited by examiner

*Primary Examiner*—Ross Gushi
(74) *Attorney, Agent, or Firm*—Volpe and Koenig, P.C.

(57) ABSTRACT

A plug connector has, in a housing, an insulating member, which in a known manner receives contact elements, for example, contact pins and/or contact sockets, which are connected to individual wires or strands of an electrical cable. The plug connector also includes a clamping member or clamping insert in order to also fix the electrical cable relative to the housing, which takes place by a clamping nut, preferably by a union nut. In order to easily assemble these parts and to maintain a given spacing in the axial direction, the insulating member and the clamping member are connected by at least one, and preferably a plurality of spacers, with a radially open interspace remaining free laterally of the spacers, and between insulating member and clamping member. The insulating member and the clamping member are preferably separate parts, which can be reciprocally connected by the spacers.

15 Claims, 5 Drawing Sheets

PLUG CONNECTOR HAVING A HOUSING AND A CLAMPING INSERT

BACKGROUND

The invention relates to a plug connector having a housing, in which an insulating member is arranged containing an electrical contact element, for example contact pins and/or contact sockets. The contact elements are connected with individual wires or strands of an electrical cable in the use position. A clamping member for this electrical cable is arranged in the use position axially spaced from the insulating member. The housing of the plug connector has a counter-thread for a clamping nut cooperating with the clamping member, in particular for a union nut.

Plug connectors of this type are known. As a rule, the insulating member contains either contact pins or contact sockets, so that it is made possible reciprocally to plug together the plug halves. Mounting of the parts to be placed one behind the other in the axial direction is then difficult; above all, the clamping insert or clamping member has to be inserted with great care, since it already encloses the cable, which in its turn is connected to the contact elements held by the insulating member. The insulating member and the clamping member in their end position are provided with an axial space between them, since this makes it possible to let an outer screening of the cable, as a rule a screening braid, to emerge radially between the mutually facing end sides of the clamping member and the insulating member, so that the outward facing or bent-around portion of the screening or of screening wires can be turned up, in particular conductively, between this and the outer housing. During assembly, i.e., during the axial introduction of the insulating member and of the clamping member, in some circumstances relative movements between these two parts can arise, so that wires of the electrical screening can come to lie in an undesired position, in the worst case even in touching contact with the contact elements.

SUMMARY

The invention thus has the object of providing a plug connector of the kind mentioned at the beginning, in which assembly is facilitated and the danger of incorrect positioning of wires of an optionally present screening is prevented to the extent possible.

To attain this object, the initially defined plug connector is characterized in that the insulating member and the clamping member are connected by at least one spacer, and a radially open interspace between the insulating member and the clamping member remains free laterally of this spacer.

By this connection of the insulating member and the clamping member by a spacer, relative movements between these parts during insertion and fixing in the housing are avoided. It is nevertheless possible to fixedly connect individual strands to the contact elements—possibly before their insertion into the insulating member—and if necessary thereafter to deform an optionally present screening radially outward in the region of the interspace between the insulating member and the clamping member and against the plug-in direction, so that a portion of the electrical screening, thereby located on the outside, comes to abut in the use position on the inside of the at least partially electrically conducting housing, and cooperates with this housing, which is as a rule metallized or metallic or otherwise electrically conducting. The mounting of the individual parts in the housing is in any case, even without screening, simplified by their connection at the required spacing.

It is particularly favorable if the spacer is arranged in the region of the outer periphery of the insulating member and the clamping member and connecting these. It is then located at least near to the inside of the housing. An unimpeded through passage of the cable and its strands from the clamping member to the insulating member results thereby.

For a stable and effective embodiment of the invention it is suitable for at least two spacers, running at a spacing and in particular mutually parallel, to be provided between the insulating member and the clamping member, and distributed at the periphery, and to have a respective interspace between them, which is connected with the inner interspace between the insulating member and the clamping member, or respectively merges into this. The connection between the insulating member and the clamping member thereby becomes more stable, without preventing the possibility of deforming wires or braid portions of a screening of the cable located within, outward into the region of the inside of the housing.

An embodiment of the invention of quite special importance can comprise the insulating member and the clamping member being two separate individual parts, which are subsequently connected in their use position and held at a mutual distance by means of the spacer(s). This makes it possible, first in a convenient manner to connect the strands with the contact elements of the insulating member, and to bring an optionally present screening braid with respect to the clamping member into its use position and then before assembly, or respectively before introduction of these portions into the housing, to connect the insulating member and the clamping member by means of the spacer so that thereafter relative movements between these parts are no longer possible.

For subsequent connection of the insulating member and the clamping member, a latch or snap connection can be provided. These parts can thereby be plugged together by an axial movement and be quickly brought into the use position, without for example a relative rotation being required for the mutual connection.

One preferred embodiment can provide that at least one of the spacers is formed as a portion of the latch connection between the insulating member and the clamping member. This spacer thereby obtains a function additional to that of setting the axial distance between the insulating member and the clamping member, namely the function of also producing the mutual connection.

It can be advantageous if two, three, four, or more spacers oriented in the axial direction are provided, of which at least one, and preferably a plurality or all, is/are formed as latch fingers, and at the end of such a latch finger there is provided a latch projection for latching in a counter-opening, for example in an annular groove, or a latch aperture provided for engagement of a latch projection. Above all, with the formation of more or all spacers as latch fingers, there results a stable connection which however is releasable under given circumstances.

The spacers can be arranged integrally on the insulating member, and the clamping member can then have the latch aperture or latch projections. It is thereby above all possible to use the clamping member in other cases of application, since it itself is free of spacers. It can also be used in such cases in which no plug connector is to be produced, and no insulating member is present. The clamping insert is also available in the same size and shape also for other clamping screw connections.

An advantageous embodiment of the plug connector according to the invention can provide that the spacers are formed as latching fingers with radially inwardly directed latch projections, and as a counter-recess(es) on the counterpart member, in particular on the clamping member or the insulating member, an annular groove is provided into which the latch projections of the spacers pass and can be latched. The annular groove has the advantage that care does not have to be taken about an exact opposite alignment of clamping member and insulating member in the reciprocal plug assembly.

The latchable spacer(s) can comprise elastically flexible material and be bendable outside the housing of the plug connector for releasing the latch connection. Both latching and possible separation of clamping member and insulating member could thus be performed without problems outside the housing. However, within the housing an elastic bending of the spacers outward in the radial direction—which acts to release the latch connection—is blocked by the housing, so that the latch connection is unreleasably set in the use position by the housing enclosing the whole unit.

This can be further advanced in that the spacers running somewhat outside between the insulating member and the clamping member are nearly or about flush with the outsides or surfaces of the insulating member or the clamping member which in the use position lie close to the inner side of the housing or even contact this inner side.

It can thus be attained above all by a combination of the preceding measures that the spacers formed as latch fingers, with their latch projections latching from outside in a counter-recess or annular groove, are fixed in their latching position by the housing which encloses them in the use position. Tension forces acting on the cable are substantially taken up by the clamping screw connection, and so can in no case act on the connection of the wires or strands of the cable with the contact elements.

So that the plug connector includes as few parts as possible, it is appropriate if the spacer(s) are integrally connected to one of the parts held apart, in particular with the insulating member or the clamping member. This can already take place during manufacture, so that no additional assembly is needed for installation of the spacer(s).

A particularly advantageous development can be provided in that the integral connection of the spacer(s) with the clamping member or with the insulating member has a predetermined breaking point. It is thereby possible to break off the spacer(s) and to use the clamping member and above all the insulating member for plug connectors which contain no cable screw connection, but for example are installed fixed to a piece of equipment.

Above all, by combination of a single or a plurality of features and measures as described hereinabove, a plug connector results which permits a fixed connection of the cable and the strands, and a simple radial deformation of a portion of the cable screening between the clamping member and the insulating member, without difficulties of mutual positioning and of maintaining the required mutual distance arising when introducing the insulating member and the clamping member into the housing.

BRIEF DESCRIPTION OF THE DRAWINGS

Exemplary embodiments of the invention are hereinafter described in detail hereinafter with reference to the drawings.

FIG. 5 is a diagram, corresponding to FIG. 2, of the embodiment according to FIG. 4, after the introduction of the contact elements into the insulating member and after its axial connection to the clamping member before the insertion of the insulating member and of the clamp insert into the housing of the plug connector and before the union nut is screwed on.

DETAILED DESCRIPTION OF THE PREFERRED EMBODIMENTS

Figure 1:
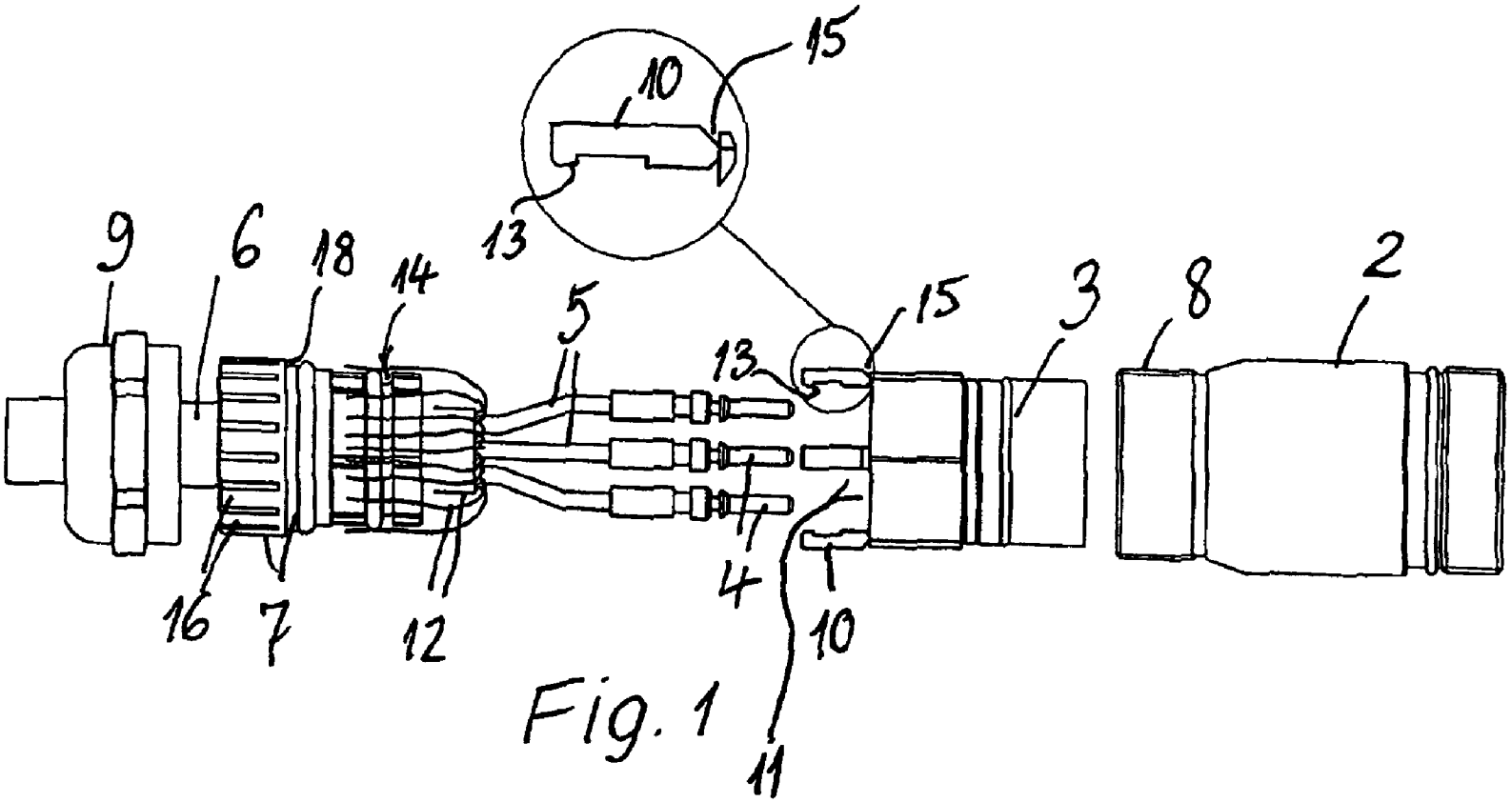
FIG. 1 is a side view of the individual parts of the plug connector according to the invention, before reciprocal assembly, the contact elements being already connected to wires, and a screening of a connection cable at its end, where the wire strands come out of it and are radially bent outward; the contact elements are however not yet axially connected to the insulating member.
Figure 2:
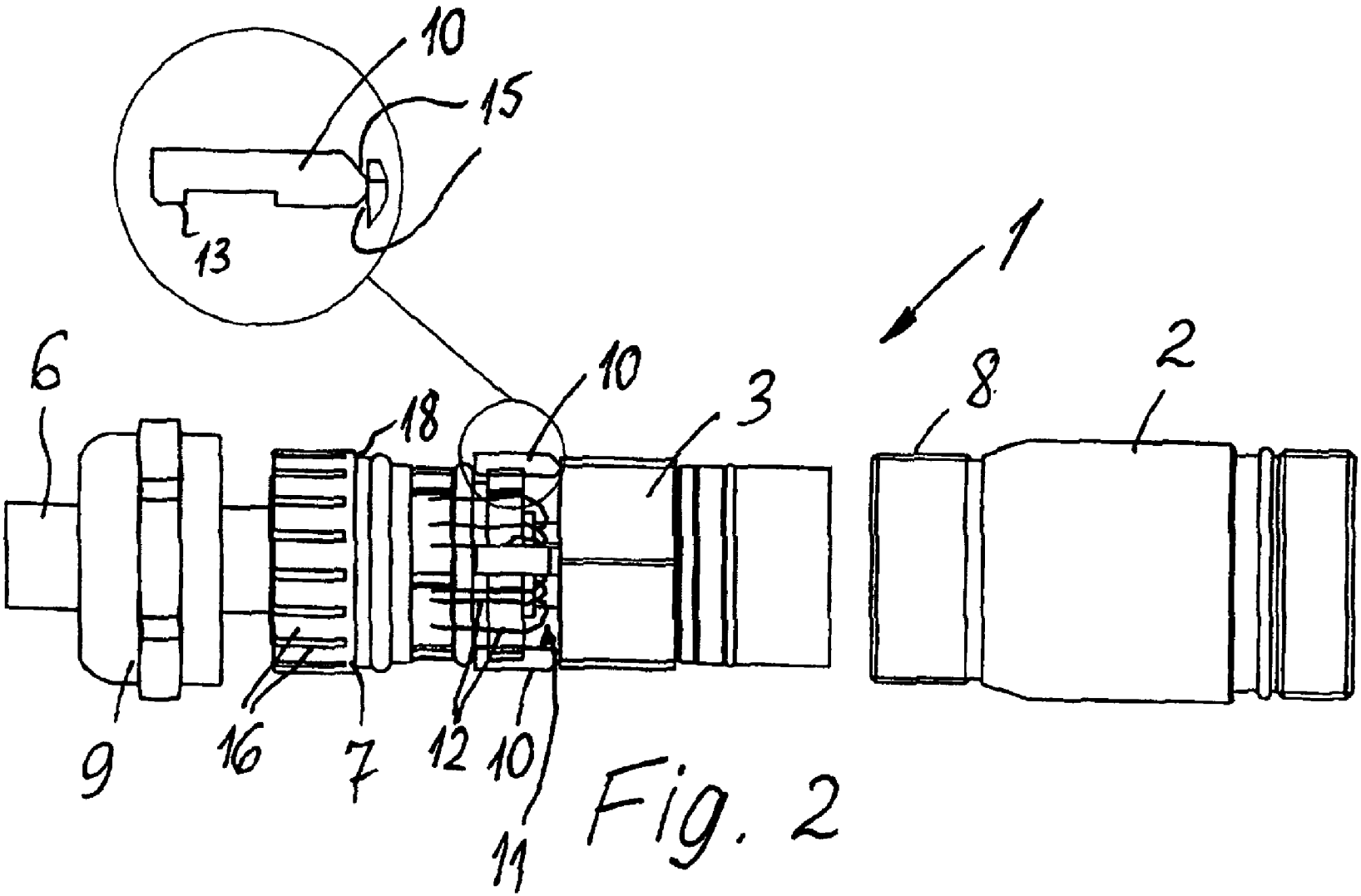
FIG. 2 is a diagram corresponding to FIG. 1 after the introduction of the contact elements into the insulating member and after its axial connection with the clamping member or clamping insert, before the insertion of the insulating member and clamping insert into the housing of the plug connector, and before the screwing on of the union nut on the external thread located at one end of the housing, from which the clamping fingers of the clamping insert stand out axially in the use position.
Figure 3:
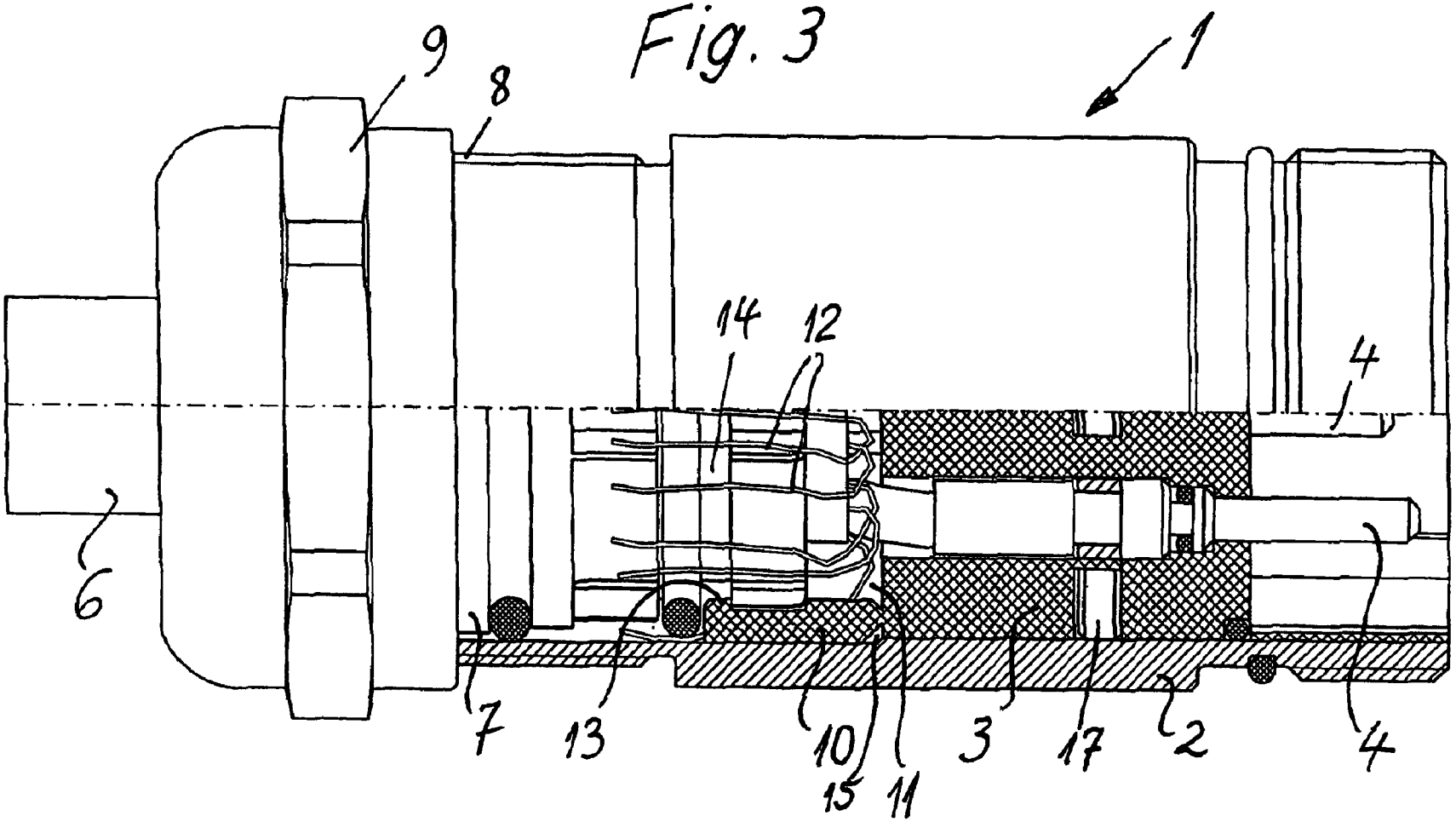
FIG. 3 is a side view on an enlarged scale and partially in longitudinal section, of the plug connector according to the invention after assembly.
Figure 4:
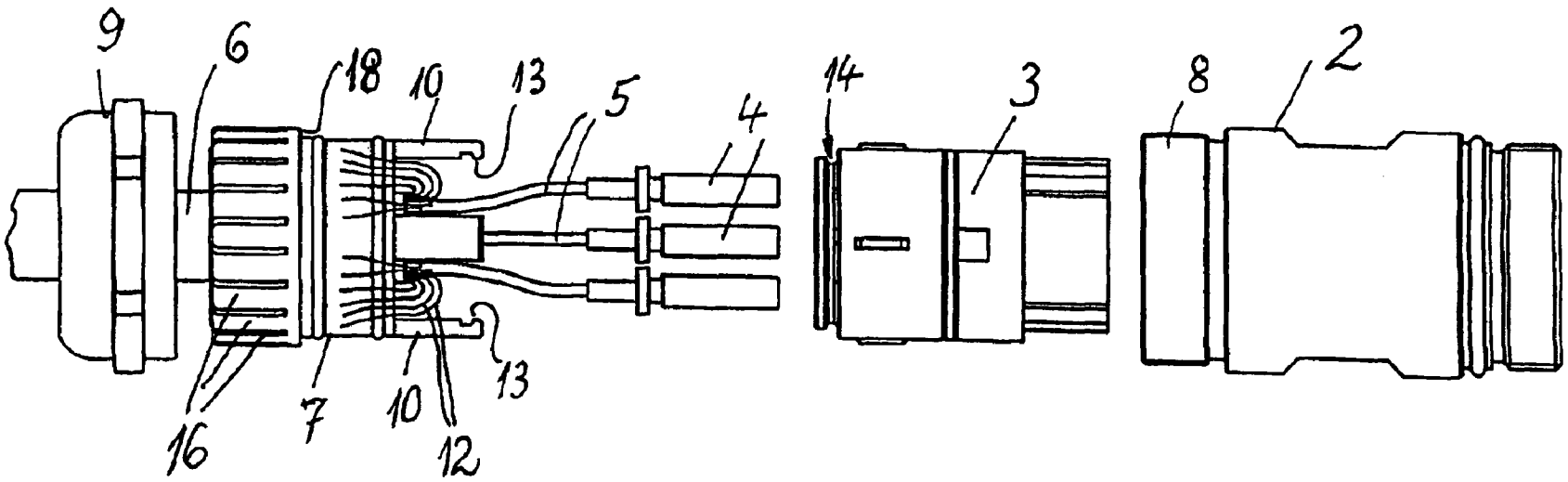
FIG. 4 is a diagram corresponding to FIG. 1 of a modified embodiment, in which spacers between clamping finger and insulating member are integrally connected to the clamping member.
Figure 5:
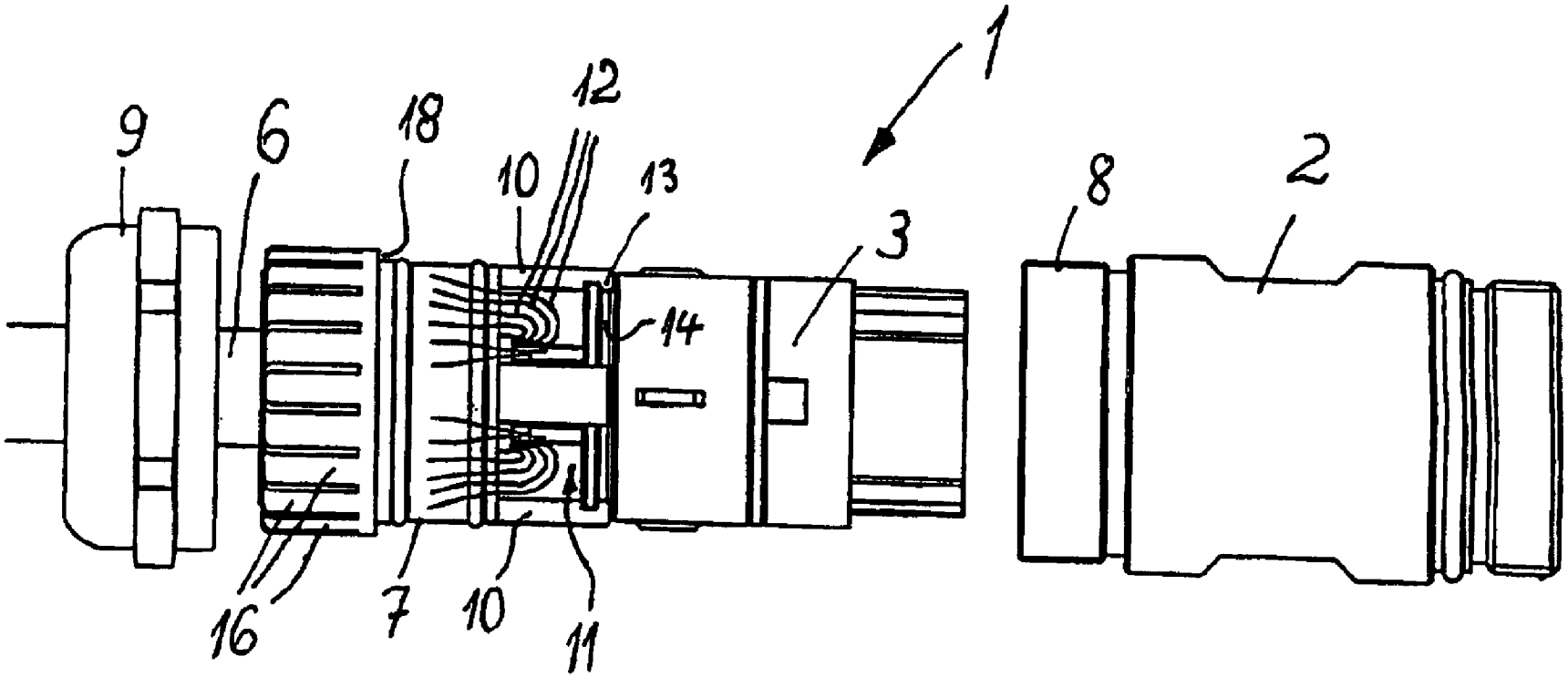

A plug connector, denoted overall by 1 in FIG. 1, has a housing 2, in which after assembly (cf. FIG. 3) an insulating member 3 is arranged, and contains the electrical contact elements 4, in the embodiment according to FIGS. 1–3 contact pins, and in the embodiment according to FIGS. 4 and 5 instead of these or additionally, contact sockets. These contact elements 4 according to FIGS. 1–5 are connected in the use position with individual wires or strands 5 of an electrical cable 6, which can be seen particularly clearly in FIGS. 1 and 4, where this connection is already formed, but the contact elements are not yet inserted into the insulating member 3.

The plug connector 1 furthermore has a clamping insert or clamping member 7 for the electrical cable 6 for fixing it axially, which is arranged in the use position according to FIG. 3 and also already in the preassembly position according to FIG. 2 with an axial space from the insulating member 3. The housing 2 of the plug connector 1 has a counter-thread 8 for a clamping nut, in this embodiment a union nut 9, cooperating with the clamping member 7. According to this, the counter-thread 8 is an external thread.

It is shown in FIGS. 2, 3 and 5 that the insulating member 3 and the clamping member 7 are connected by spacers 10, and laterally from the spacer(s) 10 a radially open interspace 11 remains free between the insulating member 3 and the clamping member 7.

While in the arrangement according to FIGS. 1 and 4 the insulating member 3 and the clamping member 7 are not yet connected, this is performed in the arrangement according to FIG. 2, so that the unit of insulating member 3 and clamping member 7, together with the already connected cable 6 according to FIG. 1, can be pushed into the housing 2. Relative movements between insulating member 3 and clamping member 7 are prevented by the spacer 10 during this assembly.

Nevertheless it is possible according to FIGS. 1 and 4 to carefully connect the individual strands or wires 5 with the contact elements 4, then to insert these into the insulating member 3, and thereafter to produce the rigid connection between insulating member 3 and clamping member 7 for the subsequent assembly. A screening 12 of the cable 1 can be seen in the figures, bent around at the emergence of the strands 5 from the cable 6 such that this screening 12 obtains the desired contact with the housing 2 within this housing.

It is also advantageous for this that an interspace 11 is established between the insulating member 3 and the clamping member 7, and is also open radially outward between the spacers 10, so that the screening 12 is accessible if required and possibly can still be corrected in its position, when the connection is produced between the insulating member 3 and the clamping member 7 according to FIGS. 2 and 5. Apart from this, this interspace 11 and the distance between the spacers 10 prevent the screening 12 undergoing undesired position changes on connecting the insulating member 3 with the clamping member 7.

It thereby can be seen from FIGS. 1–5 that the spacers 10 are arranged generally in the region of the outer periphery of the insulating member 3 and the clamping member 7, connecting these. Thus a through interspace 11 results in the interior and leaves free and makes possible a free passage for the contact elements 4 and the strands (wires) 5.

The spacers 10 respectively also have a spacing between them and extend mutually parallel between insulating member 3 and clamping member 7, and are preferably distributed uniformly at the periphery. They thus have respectively between them an interspace or an aperture which is connected with the interspace 11 between the insulating member 3 and the clamping member 7, so that also after the connection of the insulating member 3 with the clamping member 7, the interspace 11 and the bent-around and turned up screening 12 arranged therein is accessible.

It can above all be seen from FIGS. 1 and 4 that the insulating member 3 and the clamping member 7 are properly two separate parts, which in their use position according to FIGS. 2, 3 and 5 are subsequently connected, and at the same time held at a spaced apart distance, by the spacer(s) 10. The spacers 10 thus have the additional function of producing the connection between insulating member 3 and clamping member 7.

Here for subsequent connection of the insulating member 3 and the clamping member 7, a latch or snap connection is provided, which can be very easily effected by an axial guiding together of the parts into their use position, so that rotational movements are thus avoided during this reciprocal connection with a corresponding torsion of the cable 6.

The spacers 10 are advantageously formed as a portion of the latch connection between insulating member 3 and clamping member 7, in that they are shaped as latch fingers which have at their end a latch projection 13 for latching in a counter-aperture, provided as an annular groove 14 in the exemplary embodiment.

In the embodiment according to FIGS. 1–3, the spacer 10 is arranged integrally on the insulating member 3, while the clamping member 7 has the latch aperture formed as an annular groove 14. By the formation of the latch aperture as an annular groove 14, the two parts can be plugged together in an optional orientation relative to a rotation axis or else be brought into an appropriate position by a slight rotation which is favorable for the course of the strands 5 relative to the contact elements 4 and to the insulating member 3 receiving the contact elements.

The spacers 10 are thus formed as latch fingers, which are shown in FIGS. 1 and 2 as detail enlarged in the circle. They have the already mentioned, inwardly-directed latch projections 13, which fit into the annular groove 14, and latch-in during assembly.

These latchable spacers 10 are formed of elastically flexible material, so that they can also be released again from the latch connection, outside the housing 2 of the plug connector 1, in that they can be bent up a little. This flexibility can be further enhanced by a material weakening provided at the initial position of the spacer 10 and simultaneously representing a predetermined breaking point 15.

It can be seen from FIG. 3 that the spacers 10 extending generally on the outside between insulating member 3 and clamping member 7 have their outer surfaces nearly flush with the outer sides or surfaces of the insulating member 3 or the clamping member 7, and in each case abut in the use position on the inside of the housing 2, and thus are prevented from an undesired bending against their stop or latch position by the housing 2. They are thus fixed in this use position from outside by the housing 2 in their blocking or latched-in position. If the housing is removed, they can however be released again, so that a repair or exchange of parts is possible.

In an advantageous manner, the spacers 10 are integrally connected to the insulating member 3, so that the whole arrangement has as few as possible individual parts. The integral connection of the spacers 10 with the insulating member 3 has however the said predetermined breaking point 15, which on the one hand facilitates the pivoting or bending of the spacers, but also makes it possible for the spacer 10 to break off when the insulating member 3 is to be used for a plug connector or plug which contains no clamping member or respectively no cable screw connection, but for example is installed fixed to a piece of equipment.

It can be clearly seen from FIG. 3 that the latch fingers 16 formed by axial slots and belonging to the clamping member 7 or clamping insert stand out axially over the housing 2, so that they are grasped by the union nut 9 and can be pressed against the cable 6 by tightening the union nut 9 on the thread 8 of the housing 2. In this assembly position the union nut 9 thus to some extent belongs with the housing 2 or adjoins this axially at the end opposite to the contact elements 4 or contact pins. In a known manner, sealing rings can thereby be arranged in the interior of the plug connector 1 at the required places.

For the assembly of the plug connector, firstly the strands 5 of the cable 6, with insulation removed, are connected to the contact elements 4 and furthermore the screening 12 at the end of the cable 6 is turned up and outward, so that this screening 12 runs over a portion of the outside of the clamping member 7. Thereafter, the contact elements 4 are pushed into the insulating member 3 and in a known manner axially fixed, for example with a retaining clip 17. At the same time, the insulating member 3 can be connected by means of the spacer 10 formed as a latch finger to the clamping member 10 and kept at the predetermined distance, so that the unit shown in FIG. 2 of insulating member 3 and clamping member 7 is produced, with already inserted cable 6 and fixed strands 5. This unit can then in a simple manner be pushed into the housing 2 or vice versa, the housing 2 can be pushed onto this unit, until a stop 18 of the clamping member comes to abut against the corresponding end. After this, all that is needed is to screw the union nut 9 on, in order to give a finished plug connector. The assembly is thus simple and the danger is avoided of the screening 12 reaching an undesired position or even coming into contact with the contact elements 4.

In the exemplary embodiment according to FIGS. 4 and 5, the spacers 10 are arranged integrally on the clamping member 7 and the insulating member 3 has the latch aperture formed as an annular groove 14. Apart from this exchange of arrangement of the spacers 10, all the other features and measures of the embodiment example according to FIGS. 1–3 are also similar for the embodiment according to FIGS. 4 and 5. For example, the outer sides of the spacers 10 have their outer surface about flush with the outer side of the clamping member 7. Furthermore, also in this embodiment, in the final assembly position, the spacers 10 formed as latch fingers, engaging with their latch projections 13 from the outside into a counter-recess or annular groove 14, are fixed by the housing 2 enclosing them in their latched-in or holding position. The analog is true for the flexibility of the spacer 10 and a possible predetermined breaking point 15, which may however be omitted in the embodiment according to FIGS. 4 and 5.

The plug connector 1 has in a housing 2 an insulating member 3, which in a known manner receives contact elements, for example, contact pins and/or contact sockets, which are connected to individual wires or strands 5 of an electrical cable 6. Furthermore there belongs thereto a clamping member or clamping insert 7, in order to also fix the electrical cable 6 relative to the housing 2, which takes place by means of a clamping nut, preferably by a union nut 9. For a simple assembly of these parts and to maintain a given spacing in the axial direction, the insulating member 3 and the clamping member 7 are connected by at least one, and preferably a plurality of spacers 10, with a radially open interspace 11 remaining free laterally of the spacers 10, and between insulating member 3 and clamping member 7. The insulating member 3 and the clamping member 7 are preferably separate parts, which can be reciprocally latched by the spacers 10.

What is claimed is:

1. A plug connector (1) comprising a housing (2), in which an insulating member (3) containing electrical contact elements (4), for example contact pins or contact sockets, is arranged, the contact elements (4) in a use position being connected to individual wires or strands of an electrical cable (6), which in the use position is arranged at an axial distance from the insulating member (3), the housing (2) of the plug connector (1) having a counter-thread (8) for a clamping nut, particularly a union nut (9), cooperating with a clamping member (7), wherein the insulating member (3) and the clamping member (7) are connected by at least one spacer (10) and laterally of the spacer a radially open interspace remains free between the insulating member (3) and the clamping member (7).

2. The plug connector according to claim 1, wherein the spacer (10) is arranged generally in a region of an outer periphery of the insulating member (3) and the clamping member (7), to connect the insulating member and the clamping member together.

3. The plug connector according to claim 1, wherein the at least one spacer comprises at least two spacers (10), spaced apart and in particular extending mutually parallel to one another provided between the insulating member (3) and the clamping member (7) and the spacers are distributed around a periphery and have between them respectively an interspace, which is in connection with the interspace (11) between the insulating member (3) and the clamping member (7).

4. The plug connector according to claim 1, wherein the insulating member (3) and the clamping member (7) are two separate single parts, which in the use position are subsequently connected and held at a predetermined distance by the spacer(s) (10).

5. The plug connector according to claim 1, wherein a latch or snap connection is provided for connection of the insulating member (3) and the clamping member (7).

6. The plug connector according to claim 1, wherein at least one of the spacers (10) is formed as part of a latch connection between the insulating member (3) and the clamping member (7).

7. The plug connector according to claim 1, wherein the at least one spacer comprises two, three, four, or more spacers (10) oriented in the axial direction, of which at least one, is formed as a latch finger, and at an end of the latch finger there is provided a latch projection (13) for latching in a counter-aperture or latch aperture provided for engagement of a latch projection.

8. The plug connector according to claim 7, wherein the spacers (10) with the ends that latch are arranged integrally on the insulating member (3), and the clamping member (7) has the latch aperture or latch apertures or latch projections.

9. The plug connector according to claim 7, wherein the spacers (10) are arranged integrally on the clamping member (7) and the insulating member (3) has the latch aperture or latch apertures or latch projections.

10. The plug connector according to claim 7, wherein the spacers (10) are formed as the latching fingers with radially inwardly directed latch projections (13), and a counter-recess is provided on the counterpart member, in particular on the clamping member (7) or on the insulating member (3), comprising an annular groove (14) into which the latch projections of the spacers (10) can be latched.

11. The plug connector according to claim 10, wherein the latchable spacer(s) (10) comprise elastically flexible material and are bendable outside the housing (2) of the plug connector (1) for releasing the latch connection.

12. The plug connector according to claim 1, wherein the spacers (10) extend on an outside between the insulating member (3) and the clamping member (7) and have outer surfaces nearly flush with outer sides or surfaces of the insulating member (3) or the clamping member (7).

13. The plug connector according to claim 1, wherein the spacers (10) are formed as latch fingers, latching with latch projections from outside into a counter-recess or annular groove (14), and are fixed in a latching position by the housing (2) enclosing them in the use position.

14. The plug connector according to claim 1, wherein the spacer(s) (10) is/are integrally connected with one of the parts held at a spacing, in particular with the insulating member (3) or the clamping member (7).

15. The plug connector according to claim 14, wherein the integral connection of the spacer(s) (10) with the clamping member (7) or with the insulating member (3) has a predetermined breaking place (15).

* * * * *